United States Patent [19]

Johnson

[11] Patent Number: 4,735,155

[45] Date of Patent: Apr. 5, 1988

[54] FIRE RESISTANT ENCLOSURES

[75] Inventor: Hugh W. Johnson, Banbury, England

[73] Assignee: The Johnson Company Limited, Warwickshire, England

[21] Appl. No.: 935,930

[22] Filed: Nov. 28, 1986

Related U.S. Application Data

[63] Continuation-in-part of Ser. No. 730,943, May 6, 1985, abandoned.

[30] Foreign Application Priority Data

Mar. 14, 1985 [GB] United Kingdom ..... 8506572

[51] Int. Cl.[4] ..... E05G 3/00

[52] U.S. Cl. ..... 109/24; 109/65; 109/80

[58] Field of Search ..... 109/24, 65, 80–84, 109/59 R, 59 T; 70/329, 333

[56] References Cited

U.S. PATENT DOCUMENTS

| | | | |
|---|---|---|---|
| 711,325 | 10/1902 | Lowrie | 70/329 |
| 960,767 | 6/1910 | Allen | 109/82 |
| 1,843,619 | 2/1932 | Norris | 109/24 |
| 4,048,926 | 9/1977 | Brush, Jr. et al. | 109/65 |
| 4,376,380 | 3/1983 | Burgess | 70/329 |
| 4,422,386 | 12/1983 | Carpenter | 109/84 |

FOREIGN PATENT DOCUMENTS

| | | | |
|---|---|---|---|
| 0023621 | 7/1982 | European Pat. Off. . | |
| 1584258 | 1/1970 | Fed. Rep. of Germany . | |
| 53-16694 | 2/1978 | Japan | 109/82 |
| 7502691 | 9/1975 | Netherlands | 109/84 |
| 1373908 | 11/1974 | United Kingdom . | |
| 1500046 | 2/1978 | United Kingdom . | |

OTHER PUBLICATIONS

"Engineering Materials Handbook", C. L. Mantell, McGraw-Hill, N.Y., N.Y., 1958.

*Primary Examiner*—Neill Wilson

*Attorney, Agent, or Firm*—Solon B. Kemon

[57] ABSTRACT

A fire-resistant enclosure comprises a casing, a hollow internal compartment defined by said casing, a door opening defined in said casing and providing access to the internal compartment and a door fitted into and closing said opening. Both the door and at least that part of the casing defining the door opening are constructed primarily from rigid fire-resistant intumescent material comprising a resin incorporating a blowing agent such that when subjected to heat the material of the door and the material of the casing at the door opening swell towards each other and provide a heat and water resistant seal between said door and said door opening.

14 Claims, 4 Drawing Sheets

FIRE RESISTANT ENCLOSURES

CROSS REFERENCE TO RELATED APPLICATION

This application is a continuation-in-part of my U.S. patent application Ser. No. 730,943 filed May 6, 1985, now abandoned.

BACKGROUND OF THE INVENTION

This invention relates to fire-resistant enclosures.

Fire resistant enclosures or fire safes normally comprise a metal structure lined with one or more layers of insulating matreial. With the advent of a requirement for protection against fire of valuable computer software stored on magnetic discs or tapes, the requirement of a fire safe is not merely to prevent combustion of the contents but also to prevent its temperature rising to a level where the stored data is destroyed. This can be much lower than a typical conmbustion temperature and requires new standards for fire resistance. Features such as additional layers of insulation, new insulation materials and wax containers which absorb heat on melting of the wax are all of assistance in improving the performance of fire resistant enclosures or fire safes. To achieve a high total performance from the fire resistant enclosure, corresponding improvements are needed in the effectiveness of door seals to prevent the passage of heat into the enclosure through the join between a door and the part of a casing defining a door opening. Door seals of sufficient performance tend to be complex in structure, adding substantially to the total cost of the product. Normal requirements also include a need for very close tolerances in the dimensions of the door and door opening and sealing elements which remain effective over a period of several years during which the door may be opened and closed several times per day.

An object of the invention is to provide a fire resistant enclosure with a door sealing arrangement which is both simple and effective and will remain so over the life of a product even if subject to wear and abuse.

SUMMARY OF THE INVENTION

According to the present invention a fire-resistant enclosure comprises a casing, a hollow internal compartment defined by said casing, a door opening defined in said casing and providing access to the internal compartment, a door fitted into and closing said opening, both the door, and at least that part of the casing defining the door opening being constructed primarily from rigid fire-resistant intumescent material comprising a resin incorporating a blowing agent such that when subjected to heat the material of the door and the material of the casing at the door opening swell towards each other and provide a heat resistant seal between said door and said door opening.

By employing intumescent material as the structure of the door and of the door opening, any gap between the door and its opening is automatically sealed on expansion of these materials on exposure to fire, thus obviating the need for a complex sealing arrangement and a very close fit. An effective seal is vital to keep out water used to extinguish a fire because water sucked into a cooling fire safe could ruin its contents. Also, minor damage in use and incorrect closure of a door after use do not render the product of the instant invention ineffective. In contrast, undetected damage or incorrect closure of a door with many conventional fire resistant enclosures can result in a risk of fire and water exposure which remains unnoticed until a fire occurs and vital information is lost.

In one form of the invention a thermal insulation material of an incombustible nature comprising microporous silicas, ceramic fibres and opacifiers is provided between both the casing and door and the compartment. The casing and door can be provided, adjacent to the compartment with an interior space substantially filled with a low-melting point wax.

BRIEF DESCRIPTION OF THE DRAWINGS

Embodiments of the invention will now be described in conjunction with the accompanying drawings in which.

DESCRIPTION OF PREFERRED EMBODIMENTS

Figure 1:
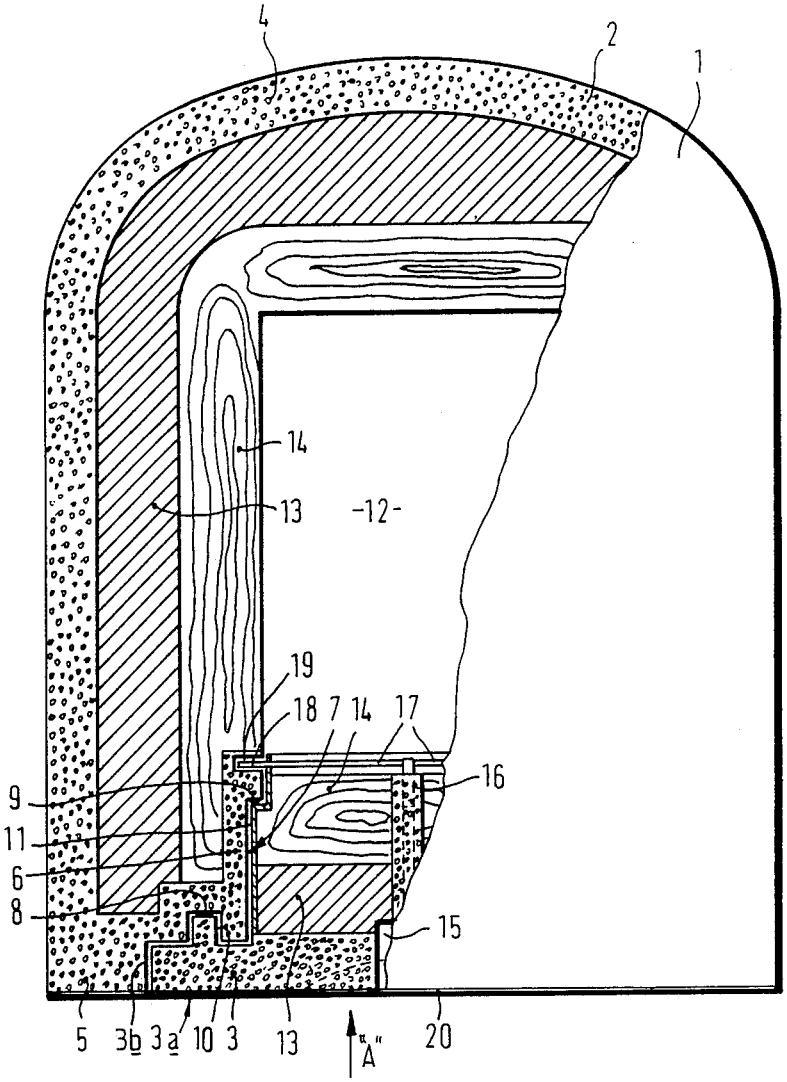
FIG. 1 is a part-cross-sectioned side view of a fire resistant enclosure or fire safe for coomputer software disks.
Figure 2:
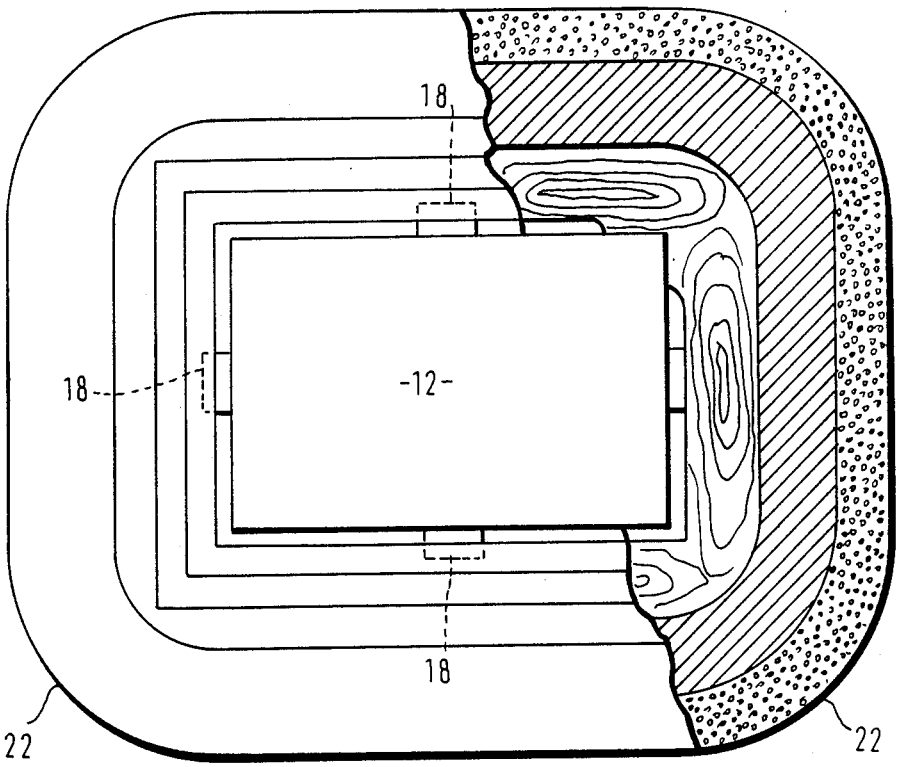
FIG. 2 is a view in the direction of arrow "A" of FIG. 1 of the base of the safe with the door removed and with a part shown in cross-section.
Figure 3:
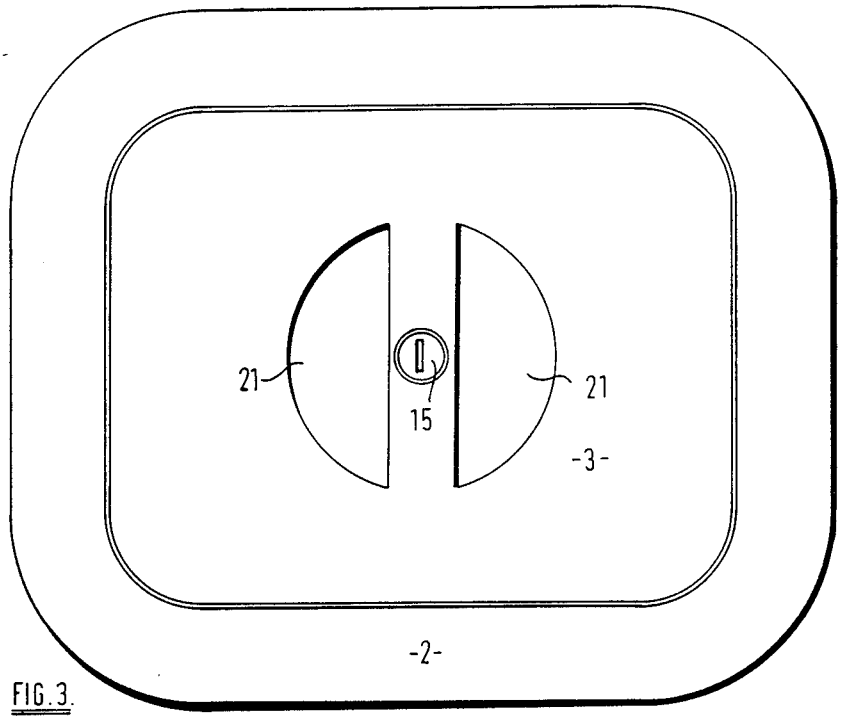
FIG. 3 is a similar view with the door in position.
Figure 4:
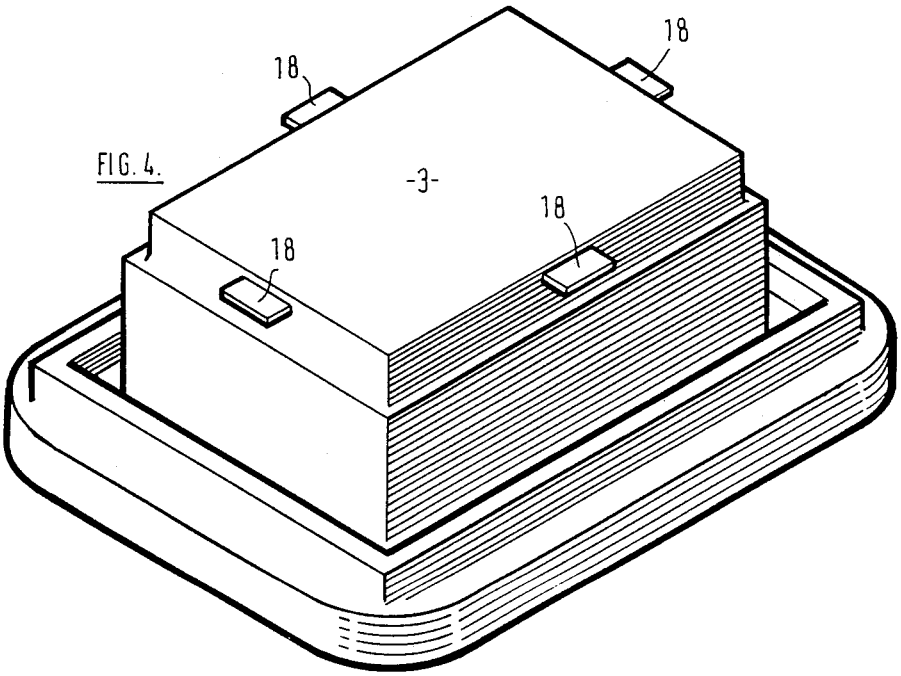
FIG. 4 is a perspective view of the door from its other side.

A fire safe 1 is provided with a casing 2 and a door 3 constituted primarily of intumescent material, that is a material displaying intumescent properties when subject to heat. The intumescent material comprises resin incorporating an insoluble blowing agent. The resin may be an epoxy polyamide and can be pigmented to add to its appearance. Such a material is described in U.S. Pat. No. 4,160,073.

The casing has a dome 4 at one end intended to stand upper-most and a flat base 5 at its other end, the door having an exterior face 3*a* lying flush with the flat base 5 and fitting into a recess 3*b* formed in the end of the casing 2. The casing has a re-entrant portion 6 which forms a recess 7 into which the door 3 fits being sealed by means of gasket seals 8 and 9 along a labyrinthine path 10 formed between door and casing.

The base part 5 of the casing is a moulding of intumescent material and the outer primary part of the door 3 is also a moulding of intumescent material. The remainder of the outer casing part is formed by building up a layer of the intumescent material by stipple-painting on a former which provides an inner layer for the casing to be described below.

It will be noted that the door is of substantial thickness and is filled with materials to be described in the manner corresponding to the casing, a moulded box-like structure 11 of a fire-resistant poly-vinyl-chloride material being disposed on the inner side of the door to contain the material. The casing 2 encloses a compartment 12, of rectangular cross-section, within the confines of the casing and door, and this constitutes the fire-resistant compartment for the storage of computer tapes, disks or the like.

The filling for the interior of the casing and the door comprises the following. There is an outermost surrounding layer 13 of mineral fibre in the form of glass wool. Metal mesh (not shown) may be incorporated in sheet form to support the fibre and an aluminium heatreflecting sheet or foil may also be incorporated. An inner layer 14 of cellulose material, which may be balsa wood, is provided. There may also be provided, though this is not shown, a lining surrounding the compartment 12 of plastics material for example, a fire-resistant plastics material such as glass reinforced polyester resin.

A lock 15, for operation by a key, is mechanically connected by means of an element in the form of a rod 16, of the same intumescent material as that from which the casing and door is made, to a set of four levers 17 each of which terminates in a tongue 18. The tongues engage with spaced-apart recesses 19 formed in the interior wall of the casing 2 to secure the door to the casing upon activation of the lock.

The lock 15 has one face 20 disposed flush with the surface 3*a* of the door, recessed portions 21 being disposed one on each side of the lock to enable the lock to be gripped in the manner of a handle.

It will be noted that the sides of the casing 2 have generously rounded corners 22 and, in alternative constructions, the cross-sectional shape of the casing can be generally rounded, circular in cross-section or of oval cross-sectional shape. Moreover, the general shape of the casing can be of bell-shape, the skirt of the bell-shape terminating at the base; the bell-shape instead of being rounded can be of ovate cross-section.

The safe according to the invention has the following advantages. When the safe is subjected to severe fire conditions the outer casing material, the outer door material and the rod 16 for the lock, being made from an intumescent material, first act to reflect back the heat. Continued exposure causes the surface of the material to intumesce and physically repel the flame. Char then develops on the material surface and erupts to reflect and radiate back the heat. A protecting blanket is formed by the char but it absorbs some of the heat which in turn causes the material below the surface to swell. The swelling of the material forces the exposed surface of the casing and door outwards towards the source of heat increasing the general thickness and heat insulating properties of the casing and door. Further stages in the protection provided are created by ablation of the char in the form of eroding powder, flakes or film to present a fresh cooler surface to the heat source. This process continues until, if exposure is long enough or sufficiently severe, the material is consumed, the period of time taken providing the required fire resistance.

The action of swelling of the material of the casing and the door in the region of the door opening causes the closing of the material together to bridge the recess and positively seal the door in the door opening. The seals 8 and 9 serve to prevent flow of warm air into or out of the compartment of the safe but the main operative sealing after exposure to fire is the swelling and closing together of the intumescent materials of the door and door opening.

If is a further advantage of the construction, according to the invention, that the domed top provided the minimum exterior surface area for a given interior volume and thus the least area for the absorption of heat to raise the temperature of valuable items enjoying the protection of the inner compartment. Similarly where rounded corners, circular, ovate or bell-shape casings are employed the cross-sectional exposed area is kept low with corresponding added advantage.

It is a still further advantage of the invention that the base upon which the safe readily stands with the domed top thus uppermost contains a flush-fitted and recessed door. When this stands on a floor or upon a concrete or other non-combustible surface there is an added obstruction to the heating effect of the fire upon the door of the safe. Safe constructions hitherto known have the door exposed on the side, radiation from a fire being able freely to play upon it.

It will be appreciated that the rounded nature of the top and sides of the safe according to the invention militate against placing the safe other than with its base downwards so that it sits neatly somewhat like a beehive or bell.

Figure 5:
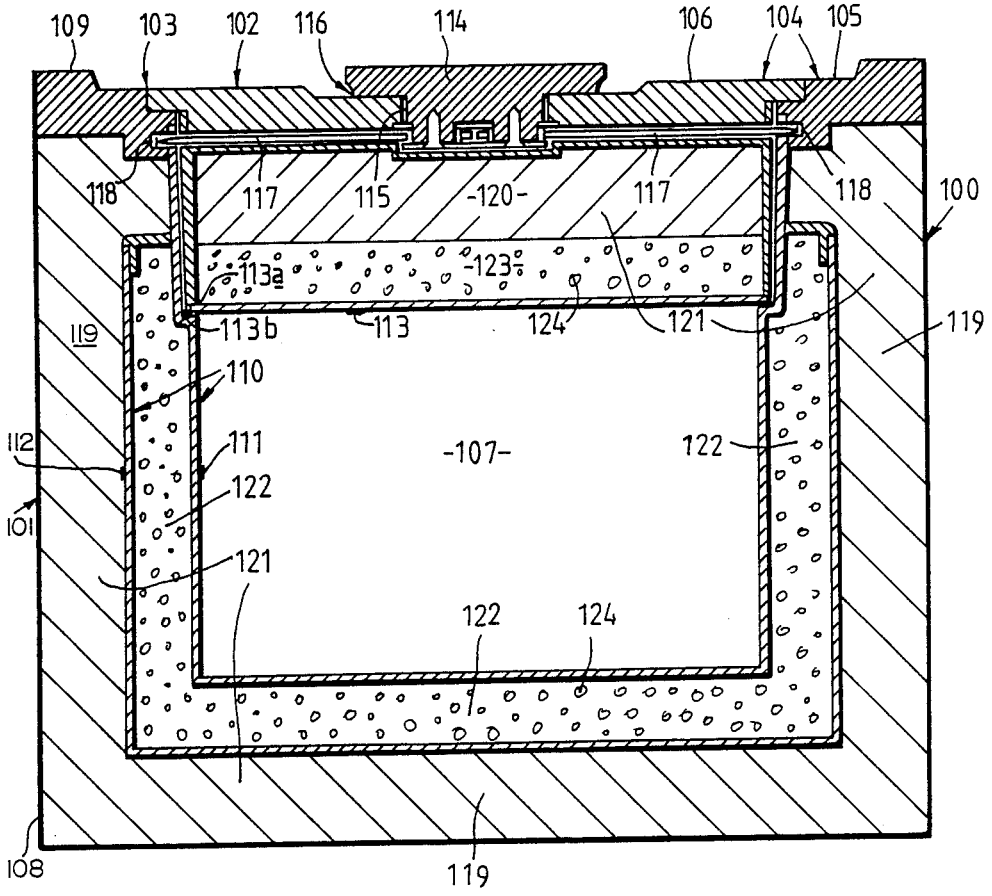
FIG. 5 is a cross-sectional side view of an alternative design of a fire safe for computer software disks.

The embodiment of the invention shown in FIG. 5 will now be described.

A fire safe 100 comprises a casing 101 and a door 102 fitting into a door opening 103 such that a flush surface 104 is formed by the top 105 of the casing and the outer surface 106 of the door. A compartment 107 is disposed within the confines of the casing and door constituting a fire-resistant container for the safe storage of computer tapes, disks or the like.

The casing 101 will first be described in more detail. The exterior surface of the casing is made from a rectangular box 108 of steel which, though not illustrated, may be coated exteriorly with an intumescent material. The door opening 103 in the casing 101 is defined by a frame 109 secured to the steel box 108, the frame being made from the intumescent material previously referred to.

The casing 101 is provided with a twin-walled plastic inner box 110 having an inner wall 111, constituting the inner wall of the storage compartment 107 and an outer wall 112 spaced from the inner surface of the box 108. The inner box 110 is secured to the frame 109 and the material of the inner box 110 is a thermosetting moulding material which contains an unsaturated polyester resin, an unsaturated cross-linking monomer such as styrene, suitable mineral fillers and glass fibre reinforcement.

The door 102 will now be described in more detail. It is made from the same intumescent material as the casing frame 109, is likewise provided with a plastic container 113 secured to the interior surface of the door and made from the same material as that of the inner box 110 of the casing. The door 102 has a handle 114 made from intumescent material, the handle being a close fit within an aperture 115, a further small aperture 116 being provided between the handle 114 and the outer surface of the door. Levers 117 attached to the handle project radially in opposite directions and are engageable with associated recesses 118 formed in the frame 109 to secure the door 102 to the casing 101. A seal 113*a* is disposed in a recess 113*b* formed on the inner box 110.

Both the casing and door, by virture of the twin-walled plastic box 110, and the plastic container 113, are provided with filling materials to supplement the fire-resistance of the safe 100. The space 119, disposed between the box 108 and the outer wall 112 of the box 110 within the casing 101, and also the space 120, within the container 113 secured to the door, are each filled with a thermal insulation material 121 of an incombustible nature comprising microporous silicas, ceramic fibres and opacifiers. In addition, the space 122 within the twin-walled box 110 of the casing 101 and also the space 123 within the container 113 secured to the door are each substantially filled with a low-melting point wax 124 having a melting point of 38° C.

It is an advantage of the fire safe 100 that, when subjected to heat, the casing frame 109 and the door 102 together with the handle 114, all being made from the intumescent material referred to, act in the same way as has been described for the embodiment of FIGS. 1 to 4, swelling to seal the door in its door opening and so sealing off all access of heat, fire and water to the storage compartment 107. Further substantial protection is provided by the two fillings, in the casing box and door container respectively, of thermal insulation material 121 and low-melting point wax 124.

It will be appreciated that the fire safe 100 can be made small, portable and light in weight and can be placed free-standing near to a computer. The fire safe 100 complete with contents can also be placed within a larger conventional fire protection safe to provide even greater protection for its contents.

I claim:

1. A fire resistant enclosure comprising a casing, a hollow internal compartment defined by said casing, a door opening defined in said casing and providing access to the internal compartment, a door fitted into and closing said opening, both the door and at least that part of the casing defining the door opening being constructed primarily from rigid fire-resistant intumescent material comprising a resin incorporating a blowing agent such that when subjected to heat the material of the door and the material of the casing at the door opening swell towards each other and provide a heat resistant seal between said door and said door opening.

2. A fire resistant enclosure according to claim 1 wherein a lock is provided mechanically connected to levers by means of an element formed from an intumescent material.

3. A fire-resistant enclosure according to claim 1 provided with a lock and wherein the said door has an aperture for a handle connected to the lock, the handle being made from a rigid fire-resistant intumescent material such that the material of the handle in the region of the aperture and the adjacent material of the door will swell to close the material together to bridge the aperture.

4. A fire-resistant enclosure according to claim 1 wherein an outer face of the door is substantially flush with an outer surface of the casing.

5. A fire-resistant enclosure according to claim 1 wherein the sides of the casing have rounded corners.

6. A fire resistant enclosure according to claim 1 wherein the casing has a domed top and an opposite flat base.

7. A fire resistant enclosure comprising a casing, a hollow internal compartment defined by said casing, a door opening defined in said casing and providing access to the internal compartment, a door fitted into and closing said opening, both the door and at least that part of the casing defining the door opening being constructed primarily from rigid fire-resistant intumescent material comprising a resin incorporating a blowing agent such that when subjected to heat the material of the door and the material of the casing at the door opening swell towards each other and provide a heat resistant seal between said door and said door opening wherein a thermal insulation material of an incombustible nature comprising microporous silicas, ceramic fibres and opacifiers is disposed between both the casing and door and the compartment.

8. A fire-resistant enclosure according to claim 7 wherein an outermost surrounding layer of mineral fibre and an inner layer of cellulose materialis disposed between both the casing and door and the compartment.

9. A fire-resistant enclosure according to claim 8 wherein aluminium foil is disposed between both the casing and door and the compartment.

10. A fire-resistant enclosure according to claim 7 wherein the casing is provided adjacent to the compartment with an interior space substantially filled with a low-melting point wax.

11. A fire-resistant enclosure according to claim 10 wherein the door is provided adjacent to the compartment with an interior space substantially filled with a low melting point wax.

12. A fire-resistant enclosure according to claim 7 wherein a lock is provided mechanically connected to levers by means of an element formed from an intumescent material.

13. A fire-resistant enclosure according to claim 7 provided with a lock and wherein the said door has an aperture for a handle connected to the lock, the handle being made from a rigid fire-resistant intumescent material such that the material of the handle in the region of the aperture and the adjacent material of the door will swell to close the material together to bridge the aperture.

14. A fire-resistant enclosure according to claim 7 wherein the casing is provided with a metal exterior which is coated with a rigid fire-resistant material comprising a resin incorporating an insoluble blowing agent and the material displaying intumescent properties when subject to heat.

* * * * *